United States Patent [19]

Kobale et al.

[11] 4,243,735

[45] Jan. 6, 1981

[54] METHOD OF PRODUCING LIGHT-ABSORBING EDGING ABOUT PHOSPHOR DOTS ON COLOR IMAGE SCREENS

[75] Inventors: Manfred Kobale, Faistenhaar; Hans-Peter Lorenz, Feldkirchen; Rolf Wengert, Munich, all of Fed. Rep. of Germany

[73] Assignee: Siemens Aktiengesellschaft, Berlin & Munich, Fed. Rep. of Germany

[21] Appl. No.: 12,348

[22] Filed: Feb. 15, 1979

[30] Foreign Application Priority Data

Feb. 15, 1978 [DE] Fed. Rep. of Germany ..... 2806436

[51] Int. Cl.[3] ..... H01J 29/32; H01J 29/28; H01J 9/227

[52] U.S. Cl. ..... 430/25; 427/68

[58] Field of Search ..... 427/68, 54; 430/25

[56] References Cited

U.S. PATENT DOCUMENTS

| | | | |
|---|---|---|---|
| 3,654,505 | 4/1972 | Davis et al. | 313/92 B |
| 3,858,083 | 12/1974 | Rehkopf et al. | 313/472 |
| 4,019,905 | 4/1977 | Tomita et al. | 427/68 X |
| 4,020,191 | 4/1977 | Nagashiro et al. | 427/68 X |

FOREIGN PATENT DOCUMENTS

| | | |
|---|---|---|
| 2127845 | 1/1972 | Fed. Rep. of Germany . |
| 2540132 | 1/1976 | Fed. Rep. of Germany . |
| 2526882 | 4/1976 | Fed. Rep. of Germany . |

OTHER PUBLICATIONS

Ohishi et al., "An Experimental Real-Time Color-TV Display with a DC Gas-Discharge Panel", IEEE Transactions on Electron Devices, vol. ED-22, No. 9, Sep. 1975, pp. 650-653.

*Primary Examiner*—James R. Hoffman

*Attorney, Agent, or Firm*—Hill, Van Santen, Steadman, Chiara & Simpson

[57] ABSTRACT

A slurry comprised of particulated glass-forming substances, with or without particulated relatively clear or light-colored metal oxides, dispersed in a photolacquer is applied as a uniform layer on a surface of a color image screen. Such layer is then developed via conventional photoforming techniques to produce sites or windows for phosphor dots and the resultant window-containing layer is heated, prior or subsequent to application of phosphor dots in such windows, at a temperature in the range of about 350° to 500° C. In instances where metal oxide particles are present in the slurry, the resultant layer becomes opaque or dark upon tempering and in cases where only pure glass-forming substance particles are in the slurry, the resultant layer becomes opaque or dark upon tempering in a reducing atmosphere. Electrical conductivity may be imparted to the light-absorbing coating by addition of selective conductive materials to the initial slurry.

14 Claims, 4 Drawing Figures

METHOD OF PRODUCING LIGHT-ABSORBING EDGING ABOUT PHOSPHOR DOTS ON COLOR IMAGE SCREENS

BACKGROUND OF THE INVENTION

1. Field of the Invention

The invention relates to production of colour image screens and somewhat more particularly to a method of producing a patterned opaque layer on screen substrates.

2. Prior Art

A method of producing black edging about phosphor dots on a screen substrate so as to form a light-absorbing matrix surrounding the color phosphors is known, for example as described in German Offenlegungsschrift 25 26 882. In accordance with this disclosure, a filter layer is formed from dimethyl-dicarbocyanine-paratoluene sulfonate in a carrier of nitrocellulose and solvent of acetone, and is applied, together with phosphor materials and a photoresist material to a screen surface, photographically exposed by forward and backward exposure and then developed.

Other methods of producing black or opaque edging are also known, for example as disclosed by I Oshishi et al, *IEEE Transactions On Electron Devices,* Vol. ED-22, No. 9, September 1975, pages 650–653. Generally, the there-disclosed method comprises applying a black-colored insulating layer on a screen surface and photoetching sites or windows therein for the color phosphors. Prior to applying such layers, which, for example, are composed of lamp black (soot) or carbon black (graphite), the substrate surface must first be sub-layered with a photosensitive layer over its total area. Further processing then proceeds so that layer segments from the substrate remain on the sites preselected for later application of the phosphor pigments and, after the black edging is applied, such layer segments are underetched with $H_2O_2$ and rinsed away with water so that windows for the color phosphors are formed.

Black or opaque edging must exhibit the following characteristics:

1. It must be highly light absorptive;
2. It must have good adhesion to screen substrates;
3. It must have good mechanical loadability;
4. It must have a long operating life; and
5. It must be sufficiently conductive to maintain a screen potential during excitation of such screen by a cathode ray.

The prior art methods of producing black or opaque edging about phosphor dots on image screens are relatively complicated and are uneconomical. Further, such prior art methods only partially provide the above-referenced characteristics, especially in regard to adhesive strength and mechanical loadability.

SUMMARY OF THE INVENTION

The invention provides a method of producing light-absorbing, preferably black-colored, edging or matrix, which may be electrically conductive, about phosphor dots on image screen substrates, particularly on flat color screen substrates.

In accordance with the principles of the invention, a glass screen substrate is coated on a surface thereof with a uniform photoformable layer comprised of a slurry containing particles of glass-forming substances and, optionally, particles of metal oxides, dispersed in a photolacquer. The so-applied layer is developed in accordance with conventional photoform techniques so that windows are formed in such layer for color phosphor dots to be applied later. A tempering or heating process is undertaken, either prior to or after application of the phosphor dots, at a temperature in the range of about 350° C. to 500° C.

In certain embodiments of the invention, the slurry is comprised of a mixture of a glass solder powder and a material selected from the group consisting of metal oxides, organo-metallic compounds, silicon esters e.g. tetraacetoxysilane and mixture thereof, dispersed in a photolacquer. In other embodiments, particularly where thinner layers are desired, the slurry may be comprised of organo-metallic compounds and silicon esters dispersed in a photolacquer. Exemplary organo-metallic compounds comprise sulfur resinates, mercaptans and carboxylates of Ni, Co, Pb, Pt and Au. Sulfur resinates may be obtained, for example, by boiling a select metal salt in sulfonated oil of terpentine e.g. gold-tert-dodecyl-mercaptide. These compounds disintegrate at temperatures above about 250° C. and, depending on the oxidation behavior of the particular element, the metals per se or their oxides are formed. By adding a small amount of a noble metal (i.e., Au or Pt) resinate to a non-noble metal (i.e., Ni or Pb) resinate, a certain conductivity in the light-absorbing layer can be obtained, even when such resinate mixture is heated or tempered in an oxidizing atmosphere, for example air.

In preferred exemplary embodiments of the invention, a glass solder powder (sometimes referred to as sinter glass) is formed from a mixture of lead oxide, silicon oxide, boron oxide and aluminum oxide. This mixture may, if desired, be further admixed with chromium oxide, cobalt oxide and/or nickel oxide. Depending upon the composition of the initial glass solder mixture, it is possible to produce a black edging or differently colored edging having specific properties relative to coloration, conductivity, adhesion and layer thickness. On the basis of their respective light-absorption spectra, the oxides, in their totality, produce a dark or opaque coloring in the glass solder.

In order to obtain an uniform stable color, it is preferable to first melt the oxide mixture to obtain a more or less uniform melt mass, solidify such mass by cooling and then grind it into a fine powder (i.e., having an average particle diameter smaller than about 30 μm). After such fine-ground oxide particles are obtained, they are only then admixed with a photolacquer, preferably a positive-acting photolacquer. However, in order to use photoform techniques on a layer having a thickness greater than 30 μm, it is more advantageous in obtaining a thorough exposure of such layer to add a clear or light-colored glass solder powder (without sintering) having additions which are essentially non-light absorbing or have a minimum light-absorbing characteristic, with intense pre-mixing, to the photolacquer. In this instance, the dark coloring in the developed layer is only obtained after the tempering or heating process.

A dark or black coloring may also be obtained when a glass solder (without the above-mentioned additives) is utilized, if the heating or sintering process occurs in a reducing atmosphere. In such instance, the lead oxide is reduced and produces a dark color. However, the color stability of a glass solder treated in such a manner, while adequate, is not very great.

In preferred embodiments of the invention, a mask is used for carrying out the photoform techniques in producing windows for the color phosphors in the applied layer. Such mask is, preferably identical with the base mask for the raster which contains all raster dots of the colors and which is later utilized in applying the phosphor materials. The base mask of the double-mask raster process described in commonly assigned, copending Wengert et al application Ser. No. 007,837 filed Jan. 30, 1979 can be replaced with this technique by means of the inventive light-absorbing matrix or edging.

The photoformable layer or coating, which is preferable applied by spraying, when it contains glass solder powder it is of a thickness ranging between about 75 to 30 μm and when it contains organo-metallic compounds (such as chelating compounds) is of a thickness ranging between about 0.5 to 2 μm.

During the heating or tempering process, which is carried out at temperatures up to 500° C., the edging of the invention assumes a black or colored appearance and simultaneously intensely interacts or binds with the glass substrate surface. Further, a hard, mechanically loadable layer is formed which can be controlled so as to have a thickness approximately equal to the thickness of the applied phosphor dots (i.e., about 15 to 30 μm).

The heating or tempering process may occur separately or simultaneously with the tempering of the subsequently applied phosphor dots. A separate tempering or heating process is necessary only in certain embodiments of the invention when the edging or matrix and the free glass surface between adjacent areas of such edging (i.e. in the windows of such edging), are to be coated with a conductive transparent layer, for example composed of doped indium oxide ($In_2O_3$) or doped tin oxide ($SnO_2$). Antimony or indium may be utilized as doping materials. In this manner, a proper conductivity and defined potential ratio for the applied acceleration voltage used for cathode beam excitation and also a better deflection of the impinging electrons is obtained. Such conductive transparent layer, which is deposited onto the tempered light-absorbing edging or matrix and over the entire substrate surface, is applied via cathode sputtering or pyrolysis to form a layer having a thickness of about 1 μm, maximum. Simultaneously with a production of proper electrical conductivity, the mechanical stability of the screen surface is considerably increased by applying such conductive transparent layer. In this manner, the surface impedance of the screen can be decreased to a magnitude of about 100 ohm/□ in all ares thereof. Further, by selectively altering the composition of the glass solder in the slurry initially coated onto the screen surface, the electrical conductivity of the light-absorbing edging or matrix is controllable, at least to certain limits.

DESCRIPTION OF PREFERRED EMBODIMENTS

Figure 1:
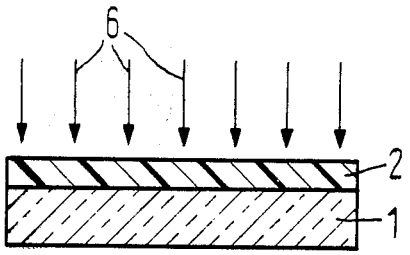
FIG. 1 is an elevated cross-sectional somewhat schematic view of a screen substrate being coated with a photo-formable slurry in accordance with the principles of the invention.

In the drawings, like reference numerals refer to like elements and FIGS. 1 through 4 show a sequential operation for forming a colour image screen (FIG. 4) in accordance with the principles of the invention. Generally, such image screen is comprised of a glass substrate 1, having a light-absorbing matrix or edging 2, with windows 2*a* therein, a transparent conductive layer 4 over the matrix 2 and free glass areas of the sbustrate berween adjacent matrix areas and phosphor dots 5 in windows formed between adjacent light-absorbing matrix areas.

In an exemplary embodiment, a photo-formable slurry is formed from a glass powder composed of 65% of lead oxide, 25% of silicon oxide, 8% of boron oxide and 2% of aluminum oxide, which is uniformly dispersed in a positively-acting photolacquer (commercially available under the trade name Kalle Pk 14). Such slurry is atomized or sprayed, as schematically indicated by arrows 6, onto a surface of a substrate 1 so as to form a substantially uniform photo-formable layer 2 having a thickness of about 40 μm.

Figure 2:
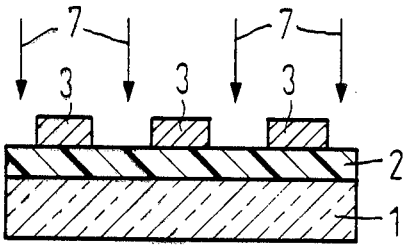
FIG. 2 is a somewhat similar view of a photo-formed layer being exposed through a mask in accordance with the principles of the invention.
Figure 3:
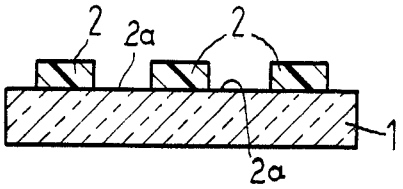
FIG. 3 is likewise an elevated schematic view of a substrate having a light-absorbing edging thereon in accordance with the principles of the invention.
Figure 4:
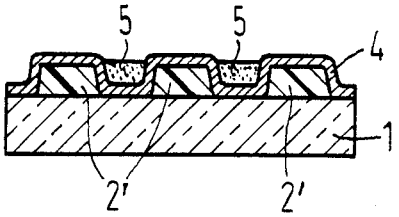
FIG. 4 is an elevated cross-sectional somewhat schematic view of a cathode tube screen constructed in accordance with the principles of the invention.

As shown in FIG. 2, a base mask 3 having a raster which is identical to the raster of the base mask later used to apply the phosphor dots, is mounted onto the photo-formable layer 2. Then, UV-radiation, schematically indicated by arrows 7, is used for exposure and the photo-formable layer is developed so that the exposed areas of the photo-formable layer 2 are removed, as with a suitable developer or solvent. The so-developed photo-formed layer 2 thus already defines the light-absorbing matrix or edging 2' and determines the position for the phosphor dots (see FIG. 3).

After tempering or heating the applied and developed photo-form layer 2 at about 480° C., which causes the layer 2 to assume a dark color and to become intensely bound to the substrate surface, and thereby form the light-absorbing matrix or edging 2', a transparent conductive layer 4 may be applied. Layer 4 is, for example, composed of tin oxided doped with indium. The layer 4 is applied over the entire surface, i.e., over areas of the light-absorbing matrix 2' and the free glass areas between adjacent matrix areas, by cathode sputtering or pyrolysis so as to form a substantially uniform layer having a thickness of approximately 1 μm.

Thereafter, the color phosphors 5 are applied in a known manner, for example, as described in the earlier-referenced Wengert et al patent application. The light-absorbing matrix or edging 2', which has a thickness greater than about 15 μm, may function as the base mask for the application of the phosphor dots.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalence may be resorted to, falling within the scope of the invention as claimed.

What is claimed is:

1. A method of producing light-absorbing edging of select conductivity on colour image screens, comprising the steps of:

(a) applying a substantially uniform photo-formable coating onto an entire surface area of a glass screen substrate, said coating being formed from a slurry composed of glass-forming substances dispersed in a photolacquer;

(b) developing the so-applied photo-formable coating via photoform techniques to that windows are formed in such coating at areas thereof corresponding to desired locations of color phosphors to be later applied; and (c) tempering the so-developed coating in a reducing atmosphere at a temperature in the range of 350° to 500° C. so as to attain a light-absorbing edging having windows therein for receiving color phosphors.

2. A method of producing light-absorbing edging of select conductivity on colour image screens, comprising the steps of:

(a) applying a substantially uniform photo-formable coating onto an entire surface area of a glass screen substrate, said coating being formed of a slurry composed of glass-forming substances and metal oxides having a relatively low light-absorption characteristic dispersed in a photolacquer;

(b) developing the so-applied coating via photoform techniques so that windows are formed in such coating at areas thereof corresponding to desired locations of color phosphors to be later applied; and (c) tempering the so-developed coating at a temperature in the range of about 350° to 500° C. so as to attain a light-absorbing edging having windows therein for receiving color phosphors.

3. A method as defined in claim 2, wherein said slurry contains a material selected from the group consisting of metal oxides, metal resinates, silicon esters and mixtures thereof.

4. A method as defined in claim 3, wherein said metal oxides are selected from the group consisting of chromium oxide, cobalt oxide, nickel oxide and mixtures thereof.

5. A method as defined in claim 2, wherein said slurry contains organo-metallic compounds and silicon esters.

6. A method as defined in claim 5, wherein said organo-metallic compounds are selected from a group consisting of sulfur resinates, mercaptanes and carboxylates of Ni, Co, Pb, Pt, Au and mixtures thereof.

7. A method as defined in claim 2, wherein said glass-forming substances are selected from the group consisting of lead oxide, silicon oxide, boron oxide, aluminum oxide and mixtures thereof.

8. A method as defined in claim 7, wherein said glass-forming substances are produced by melting such substances into a substantially uniform melt mass, cooling the resultant melt mass to obtain a solid mass and grinding such solid mass until a plurality of particles having an average maximum grain diameter of about 30 μm are attained.

9. A method as defined in claim 1, wherein a mask is used in step (b) in carrying out the photoform technique, said mask containing a raster identical to the base mask raster containing all raster points of colors on said image screen, said base mask being subsequently used to apply color phosphors onto the treated glass screen substrate.

10. A method as defined in claim 9 wherein step (a) occurs via spraying said slurry which contains powdered glass-forming substances until said coating attains a layer thickness of about 15 to 30 μm.

11. A method as defined in claim 9 wherein step (a) occurs via spraying said slurry which contains organo-metallic compounds until said coating attains a layer thickness of about 0.5 to 2 μm.

12. A method as defined in claim 1, wherein the light-absorbing edging and free glass surface areas between adjacent areas of said edging are provided with a conductive transparent layer comprised of a material selected from the group consisting of doped indium oxide and doped tin oxide prior to application of color phosphors onto the so-treated glass screen substrate.

13. A method as defined in claim 12, wherein the dopant in said material is selected from the group consisting of antimony and indium.

14. A method as defined in claim 12, wherein said conductive transparent layer has a maximum layer thickness of about 1 μm .

* * * * *